US009849599B2

(12) United States Patent
Gers-Barlag et al.

(10) Patent No.: US 9,849,599 B2
(45) Date of Patent: Dec. 26, 2017

(54) RAZOR HAVING FREE MOVABILITY OF THE RAZOR HEAD

(71) Applicant: BEIERSDORF AG, Hamburg (DE)

(72) Inventors: Heinrich Gers-Barlag, Kummerfeld (DE); Yvonne Neumann, Hamburg (DE)

(73) Assignee: BEIERSDORF AG, Hamburg (DE)

( * ) Notice: Subject to any disclaimer, the term of this patent is extended or adjusted under 35 U.S.C. 154(b) by 18 days.

(21) Appl. No.: 14/905,046

(22) PCT Filed: Jul. 11, 2014

(86) PCT No.: PCT/EP2014/064943

§ 371 (c)(1),
(2) Date: Jan. 14, 2016

(87) PCT Pub. No.: WO2015/007648

PCT Pub. Date: Jan. 22, 2015

(65) Prior Publication Data

US 2016/0136826 A1 May 19, 2016

(30) Foreign Application Priority Data

Jul. 16, 2013 (DE) ..... 10 2013 213 881

(51) Int. Cl.

| | |
|---|---|
| ***B26B 21/52*** | (2006.01) |
| ***B26B 21/40*** | (2006.01) |
| ***B26B 21/22*** | (2006.01) |

(52) U.S. Cl.

CPC ..... *B26B 21/521* (2013.01); *B26B 21/225* (2013.01); *B26B 21/4081* (2013.01); *B26B 21/52* (2013.01)

(58) Field of Classification Search

CPC ..... B26B 21/521; B26B 21/52; B26B 21/225; B26B 21/4081

USPC ..... 30/529

See application file for complete search history.

(56) References Cited

U.S. PATENT DOCUMENTS

| | | | | |
|---|---|---|---|---|
| 1,000,235 | A * | 8/1911 | Carreras | B26B 19/42 30/34.2 |
| 1,247,266 | A * | 11/1917 | Hartman | B26B 21/18 24/486 |
| 1,450,604 | A * | 4/1923 | Mossberg | B26B 21/52 30/529 |
| 1,455,726 | A * | 5/1923 | Hartman | B26B 21/52 30/529 |
| 1,933,186 | A | 10/1933 | Ryley | |

(Continued)

FOREIGN PATENT DOCUMENTS

| | | |
|---|---|---|
| DE | 260262 C | 5/1913 |
| DE | 322679 A | 7/1920 |

(Continued)

*Primary Examiner* — Hwei C Payer

(74) *Attorney, Agent, or Firm* — Abel Law Group, LLP

(57) ABSTRACT

The invention relates to a razor and a method for producing a razor. In order to provide an improved razor, a razor (1) has a handle (10), at one end of which a ball joint socket (11) is arranged, and a blade head (20) having at least one razor blade (21) and a ball joint head (22). The ball joint head of the blade head and the ball joint socket of the handle form a ball joint, and the handle has an alignment element (14) in the ball joint socket that is designed to engage with a recess (36) in the ball joint head.

20 Claims, 9 Drawing Sheets

(56) References Cited

U.S. PATENT DOCUMENTS

| | | | | | |
|---|---|---|---|---|---|
| 2,510,951 | A * | 6/1950 | Bleeker | B26B 21/24 | 30/40 |
| 2,748,470 | A * | 6/1956 | Borden | B26B 21/52 | 30/531 |
| 4,170,821 | A | 10/1979 | Booth | | |
| 4,332,321 | A | 6/1982 | Wratschko | | |
| 5,526,568 | A * | 6/1996 | Copelan | B26B 21/52 | 30/531 |
| 5,560,106 | A * | 10/1996 | Armbruster | B26B 21/225 | 30/526 |
| 5,704,127 | A | 1/1998 | Cordio | | |
| 6,381,857 | B1 * | 5/2002 | Oldroyd | B26B 21/225 | 30/526 |
| 7,966,731 | B2 * | 6/2011 | Walker | B26B 21/225 | 30/34.1 |
| 8,720,072 | B2 * | 5/2014 | Bucco | B26B 21/521 | 30/32 |
| 2013/0081291 | A1 | 4/2013 | Wain | | |
| 2016/0136826 | A1 * | 5/2016 | Gers-Barlag | B26B 21/4081 | 30/529 |

FOREIGN PATENT DOCUMENTS

| | | | |
|---|---|---|---|
| DE | 2851457 | A1 | 6/1979 |
| DE | 202006011254 | U1 | 12/2006 |
| FR | 2639280 | A | 5/1990 |
| FR | 2663255 | A2 | 12/1991 |
| GB | 2458316 | A | 9/2009 |
| GB | 2463035 | A * | 3/2010 |

* cited by examiner

RAZOR HAVING FREE MOVABILITY OF THE RAZOR HEAD

BACKGROUND OF THE INVENTION

1. Field of the Invention

The present invention relates to a razor and a method for producing a razor.

In the sense of the present invention, shaving is understood as meaning cutting the hairs on the skin to just above the uppermost layer of skin with at least one blade. This does not involve removing the hair, just shortening it.

2. Discussion of Background Information

Known razors comprise an elongate handle part, which is connected to a blade head. During use as intended, the handle part lies in the hand of the user, in order to allow the blade head to slide over the user's skin.

Such razors are usually used for wet shaving, but it is also possible that a razor in the sense of the present application also has a power supply (for example a battery or rechargeable battery), which causes a vibration in the blade head in order to bring about a massaging effect and/or increase the closeness of the shave.

These razors are available as disposable articles, with permanently installed or exchangeable blade heads and a wide variety of blade head variations with a varying number of razor blades.

DE2851457A1 describes a razor cartridge with a blade seat, a razor blade and a cap, an integral solid, water-soluble shaving aid being provided.

DE202006011254U1 describes a razor in which the connection between handle and the blade block takes place by a ball joint. The ball joint is configured as a clip connection, in which the socket of the joint or the ball of the joint can respectably change temporarily in their size.

DE322679A describes a handle for a safety razor with a spherical joint, the ball serving as a fastening element for the blade and it being possible for the frictional resistance in the ball joint to be adapted by tightening screws on the ball socket.

GB2458316A describes a razor with a ball joint between the blade head and the handle.

US2013081291A1 describes a razor with a handle having a head end, on which a blade head is pivotably arranged.

U.S. Pat. No. 4,332,321A describes a portable shaving kit with a tubular member having a socket opening and one end with a support arm having a socket within the socket opening. The support arm is movable, is held in two positions by a spring of a biased detent and has a blade support at the outer end. The blade support can be pivoted between the positions so that the blade can be housed in a cap during storage.

SUMMARY OF THE INVENTION

An object of the invention is to provide an improved razor.

In one aspect, the invention relates to a razor with a handle, at the one end of which a ball joint socket is arranged, and with a blade head having at least one razor blade and a ball joint head, the ball joint head of the blade head and the ball joint socket of the handle forming a ball joint, and the handle having in the ball joint socket an alignment element, which is designed to engage in a recess in the ball joint head.

The invention is based on the idea that a razor of which the blade head is freely rotatable by means of an arrangement in a ball joint is more satisfying and can be used reliably for shaving. The blade head or the razor blade(s) thereof can thus adapt itself/themselves particularly well to unevennesses of the skin. The blade head advantageously adapts itself flexibly to possible unevennesses or curvatures of the skin, and thus makes particularly close and safe shaving possible. The blade head glides smoothly over the skin and with the blade head adapting itself to the unevennesses of the skin, which makes shaving particularly satisfying for the user and provides uniform shaving results. This enables the user to have a close, satisfying shave without expending great force.

A ball joint refers to a joint in which the joint head has a ball-like form. The counterpart, which encloses the ball to varying degrees, is referred to as the ball joint socket or ball socket. As a result of this geometry, a ball joint is in principle movable in all directions (triaxial). Only rotational movements are possible, but not translational movements.

The handle has in the ball joint socket an alignment element which is designed to engage in a recess in the ball joint head. Alternatively or in addition, the ball joint head has an alignment element which is designed to engage in a recess in the ball joint socket. In a preferred embodiment, the alignment element is formed from an elastic material. In a preferred embodiment, the alignment element is a pin which engages in the recess in a form-fitting manner. The alignment element is preferably designed to return the joint head into a starting position. For this purpose, the alignment element engages in a recess in the ball surface that can be rotated in the joint socket to the extent allowed by the elasticity of the alignment element. If the blade head is relieved, the elasticity of the alignment element has the effect that the recess and with it the joint head and the blade head are returned into a starting position. The blade head is thus advantageously always brought back into a starting position with respect to the handle.

The razor according to the invention has in particularly preferred embodiments a blade head which is movable by up to 360° and has a ball joint head and a handle element with a joint socket. The movability of the ball joint makes possible optimal adaptation to areas of the body that are difficult to access, such as for example a knee or ankle, and thus prevents injuries in the form of cuts. The ball joint makes easy and quick changing of the blade head possible and preferably consists of a flexible material (for example TPE (thermoplastic elastomer)). Different materials and degrees of elasticity of the ball joint, in particular the joint head, allow different pressure points to be made possible in the razor. It is additionally possible for the user to vary and/or fix the degree/angle of the flexibility by placing the index finger on the ball joint.

The various levels/degrees/angles of flexibility in the ball joint are preferably obtained by the choice of material (for example different thermoplastic elastomers) and by the action of the user. The handle with a joint socket preferably consists of a strong, impact-resistant material (for example ABS (acrylonitrile-butadiene-styrene)) and may also be covered with grip elements such as roughened zones, grooving and nonslip materials. For skincare, the blade head may also include a care strip (balsam strip) with emulsions and nourishing oils.

The razor according to one aspect of the present invention is therefore a razor with a ball joint between the blade head and the handle. As a result of its high degree of movability, the ball joint, which is preferably movable by 360°, improves the adaptation of the blade head to regions of the body that are difficult to access. An individualized adaptation of the razor to different, sensitive portions of the skin can be made possible by different levels of flexibility (different materials) of different, exchangeable blade heads. The joint head may preferably comprise different materials for different pressure points. The user can advantageously determine himself/herself the degree of movability and the pressure acting on the skin by applying the index finger (braking of the ball joint).

The rotational freely movable blade head advantageously allows the achievement of flexible razor movements which adapt themselves to various areas of the skin to be shaved. Particularly sensitive shaving, in which only little pressure on the razor is necessary and superfluous pressure is intercepted by the rotation of the blade head and the optional elasticity of the ball joint, is made possible according to the invention. The blade head arranged on the ball joint adapts itself "as if of its own accord" to the surface of the user's skin. The blades thus advantageously lie closer and more directly on the skin and altogether a smaller pressure on the razor is required for shaving. The flexibility and smoothness of the shave is ensured according to the invention by lower pressure on the razor and the razor blades that rotate flexibly with respect to the handle. The shave is thus ergonomically satisfying and reduces the risk of injuries in the form of cuts.

In one embodiment, the ball joint head of the blade head is arranged detachably in the ball joint socket of the handle. The ball joint advantageously serves not only for improved movability of the blade head with respect to the handle, but also makes particularly easy changing of the blade head possible.

In one embodiment, the blade head is movable rotatably in all three directions with respect to the handle. The blade head is preferably rotatable by 360° with respect to the handle. This makes particularly great flexible movability of the blade head possible, whereby the safety and closeness of the shave is increased.

In one embodiment, the razor also has a braking element for braking a rotational movement of the ball joint head in the ball joint socket. The braking element is preferably a finger resting surface on the blade head, on which the user can place his/her finger and thereby stabilize and consequently fix (or brake) the position of the blade head with respect to the handle. Alternatively or in addition, the braking element may be a recess in the joint socket, which makes it possible for the user to place his/her finger directly on a surface region of the joint ball, and thereby stabilize and consequently fix (or brake) the position of the blade head with respect to the handle. The braking element thus makes easy limitation of the deflection of the blade head possible.

In one embodiment, the ball joint head is formed at least partially from an elastic material. It may also be preferred that parts of the joint head have different elasticities. The difference in the elasticities may be achieved for example by a suitable choice of material or by the thickness of the material layer. The subregions may be produced from the same material, the size of which varies, or comprise different materials. It may be preferred that those subregions that lie closer to the blade head are more elastic than those subregions that lie closer to the handle (or vice versa). It is thus advantageously made possible that unevennesses of the user's skin can be replicated particularly well by suitable choice of a razor with appropriate elasticity behavior in the joint head.

In one embodiment, the blade head is connected to the ball joint head by way of a connecting web. The connecting web makes particularly sensitive deflection of the blade head possible, since it acts as a kind of lever and thus already causes a rotation of the blade head when there is a relatively small pressure. In an alternative embodiment, the blade head is connected to the joint head directly (that is to say without a connecting web). This advantageously enables the user to have direct control over the blade head.

In one embodiment, the blade head has a special blade and/or a balsam strip. The razor may advantageously be supplemented by one or more special blades. The blade head therefore preferably has different types of blade, which makes an improved, more precise shave possible in different regions of the user's skin. Thus, for example, the razor blade(s) of the blade head may be suitable for shaving over a large area, which may be refined by the use of one or more smaller special blade(s). Depending on requirements, different blade heads with different special blades may be arranged on the razor, whereby the applicational flexibility is advantageously increased.

A balsam strip in the sense of the present application may be a strip that comprises for example a shaving soap, a moisturiser, a soothing skincare product, an oil or the like. It is preferred to arrange the balsam strip on the blade head adjacent and parallel to the at least one razor blade and/or the at least one special razor blade. This advantageously achieves the effect that the skin is not only shaved but also treated and cared for by the balsam strip.

A particularly smooth and close shave and skincare can advantageously be made possible by the use of one or more special blade(s) and/or balsam strip(s) on the blade head. With just one or a few movements of the razor over the region of the skin to be shaved, it is shaved closely and smoothly and thereby cared for at the same time.

Depending on use for different regions of the user's body, blade heads with a differing design and arrangement of the blade head may be arranged at the head end.

In one embodiment, the handle has grip elements for the nonslip holding of the handle by the user. The handle is preferably ergonomically formed by concave and convex curvatures and grip regions and has a nonslip lower face. The handling of the razor and its hold in the hand of the user can be advantageously improved by grip elements, such as for example roughened regions, a grooving, an adhesive surface, regions of nonslip material and/or concave/convex curvatures being provided on the handle. Thus, the handle advantageously lies particularly well in the hand, particularly safe handling of the razor is made possible and "slipping away" of the razor is prevented.

In one embodiment, the handle is formed concavely or convexly along the longitudinal axis of the razor. It may also be preferred that the handle is described in a slightly bent form and consists of strong, impact-resistant material (for example ABS (acrylonitrile butadiene styrene)). A convexly curved handle can be used ergonomically particularly more satisfyingly and also reliably for shaving, since the handle adapted to the concavely curved inner surface of the hand makes particularly ergonomic handling possible. On the other hand, a convex form of handle may be particularly advantageous to allow pressure to be applied sensitively to the joint socket end of the handle, and thus to the region of the skin to be shaved.

In one embodiment, the blade head has a multiplicity of razor blade(s). The razor blade(s) is/are arranged on a lower face of the razor, which during use of the razor as intended glides over the user's skin in order to carry out the shaving. The arrangement according to the invention of a razor blade/razor blades on the blade head that is rotatable with respect to the handle makes a particularly smooth and close shave possible, since the rotatable blade head adapts itself particularly pliably to the unevennesses of the surface of the skin.

On account of its flexible possibilities for use, the razor according to the invention is advantageously suitable for shaving part of or the whole body, and in particular for shaving under a shower.

In an alternative aspect, a razor has a handle, at the one end of which a ball joint socket is arranged, and a blade head having at least one razor blade and a ball joint socket, the ball joint head of the handle and the ball joint socket of the blade head forming a ball joint. The razor also has in the ball joint socket or on the ball joint head an alignment element, which is designed to engage in a recess in the ball joint head or the ball joint socket. In a further aspect, the razor may have instead of a ball joint a spheroidal joint. The embodiments described in the present case also apply in an analogous way to these aspects.

In a further aspect, the invention relates to a method for producing a razor of the present invention, with the steps of: providing a handle having a ball joint socket at its one end, providing an alignment element in the ball joint socket, providing a blade head having at least one razor blade and a ball joint head, and providing a recess in the ball joint head, the ball joint head of the blade head and the ball joint socket of the handle being designed to form a ball joint, and the alignment element being designed to engage in the recess.

BRIEF DESCRIPTION OF THE DRAWINGS

The embodiments described above may be combined with one another and with the aspects described above as desired in order to achieve advantages according to the invention. Preferred combinations of embodiments are described below by way of example, while

DETAILED DESCRIPTION OF EMBODIMENTS OF THE INVENTION

Figure 1A:
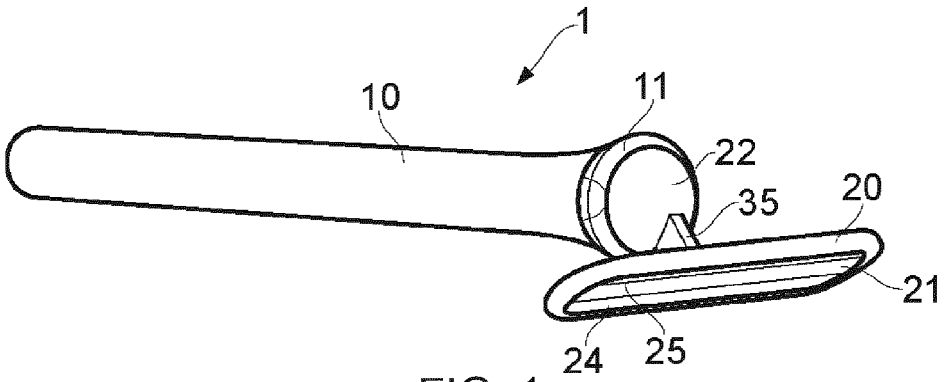
FIGS. 1*a* to 1*d* show an embodiment of a razor according to the invention.
Figure 1B:
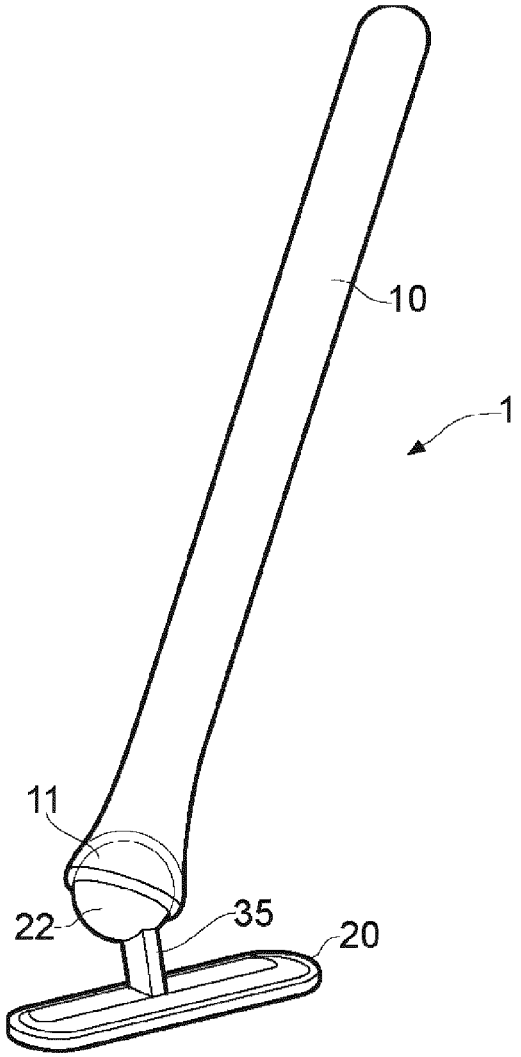
Figures 1C, 1D:
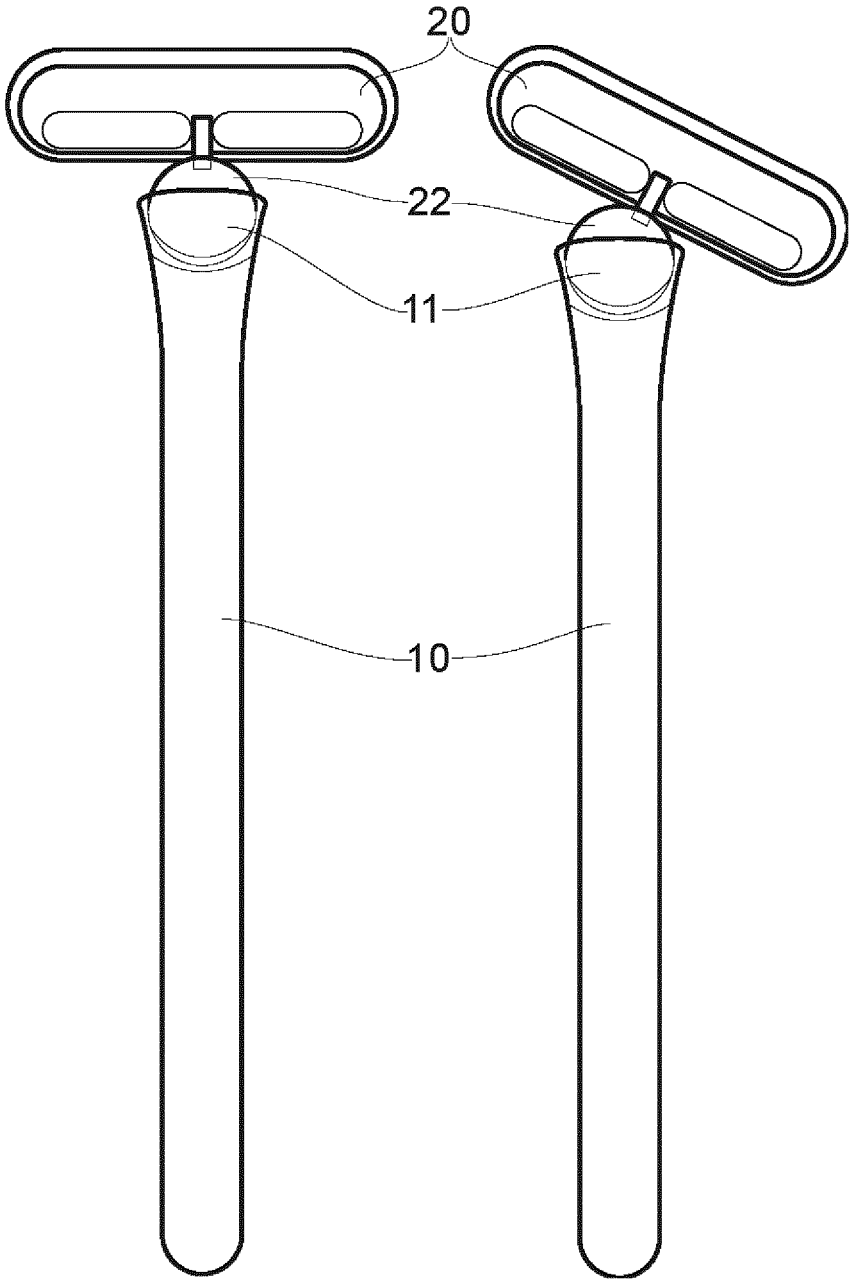

FIGS. 1*a* and 1*b* show perspective views of a razor 1 from above, and FIGS. 1*c* and 1*d* show a plan view.

The razor 1 has a handle 10 for lying in the hand of the user and also a blade head 20. At that end of the handle 10 that is facing the head end, a ball joint socket 11 is arranged. The blade head 20 has razor blades 21 and also a ball joint head 22, which is arranged on a connecting web 35, is arranged in the ball joint socket 11 of the handle 10 and thus forms with the latter a ball joint, which for example makes possible the rotation of the blade head 20 with respect to the handle 10 that is represented in FIGS. 1*c* and 1*d*.

The handle 10 may have grip elements (not represented), which make nonslip holding of the handle by the user possible. The ball joint head 22 may be formed from an elastic material, in order to achieve a resilient action of the blade head 20. The blade head 20 has in addition to the razor blades 21 skincare balsam strips 24 and 25.

Figure 2A:
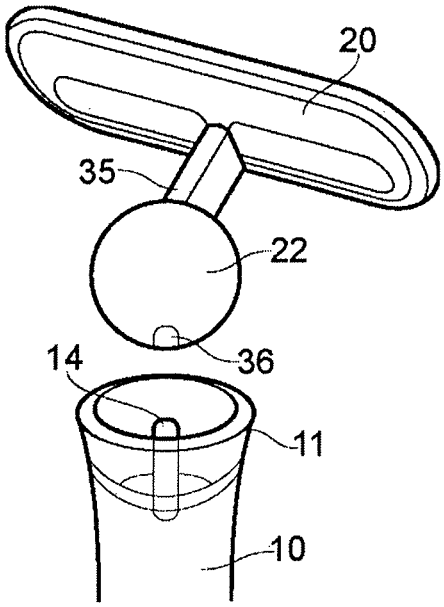
FIGS. 2*a* to 2*d* show a view of a detail of the ball joint and the blade heads of the embodiment of FIG. 1.

FIG. 2*a* illustrates the detachability of the blade head 20 from the handle 10, in that the joint head 22 is removed from the joint socket 11 in order to insert a new blade head 20, for example when the razor blades 21 have become blunt or a blade head 20 with different kinds of razor blades 21, special blades (not represented) or balsam strips 24, 25 is to be used.

The changing of the blade heads is possible in dependence on the material of the ball joints. In the case of a relatively elastic material, the attachment of a blade head by pressing into the ball joint socket is possible, in order to re-establish a form-fitting connection.

Figure 2B:
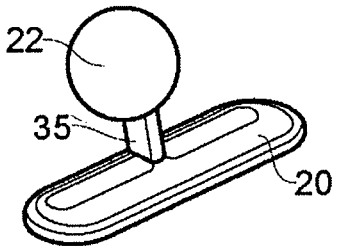
Figure 2C:
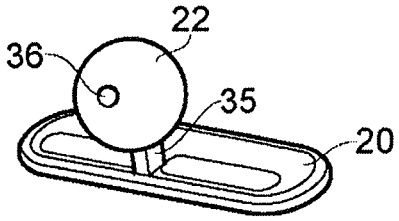
Figure 2D:
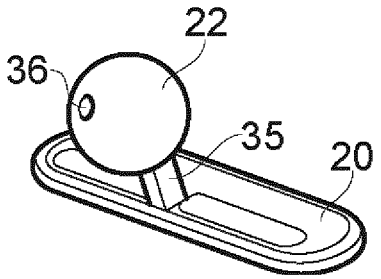

FIG. 2*a* also illustrates an alignment element 14 (alignment pin), which is provided in the joint socket 11 (which is transparently represented in order to show the alignment pin 14) and engages in a recess 36 in the surface of the joint head 22. The alignment pin 14 is elastic, and therefore allows a rotation of the blade head 20 when the blade head 20 is acted upon by the shaving pressure on the skin. The blade head 20 is returned into the starting position again by means of the alignment pin 14 as soon as it is no longer exposed to loading (there is no shaving pressure). FIGS. 2*b* to 2*d* show perspective views of the blade head 20.

Figure 3A:
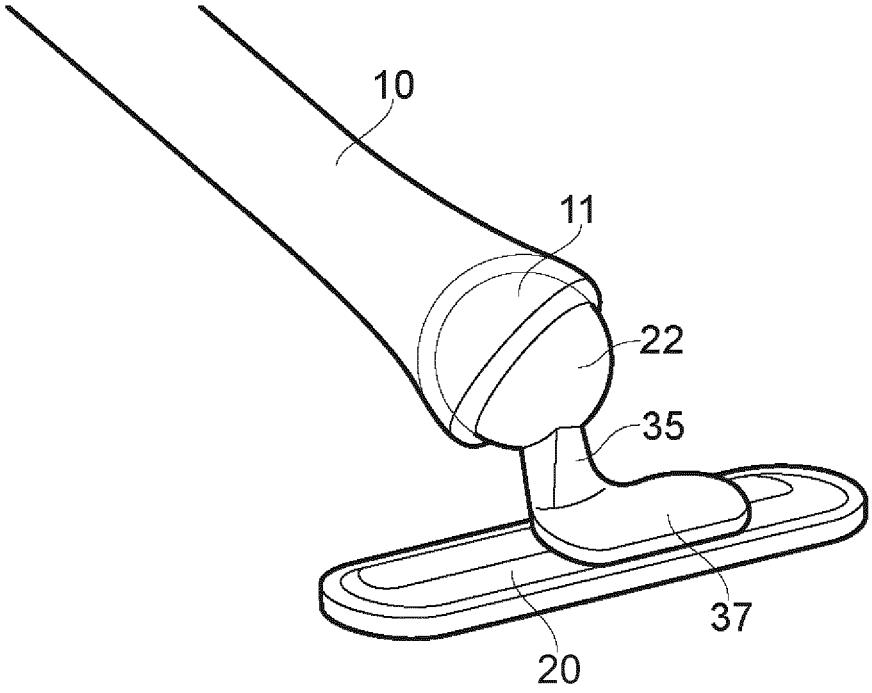
FIGS. 3*a* and 3*b* show an embodiment of a braking element.
Figure 3B:
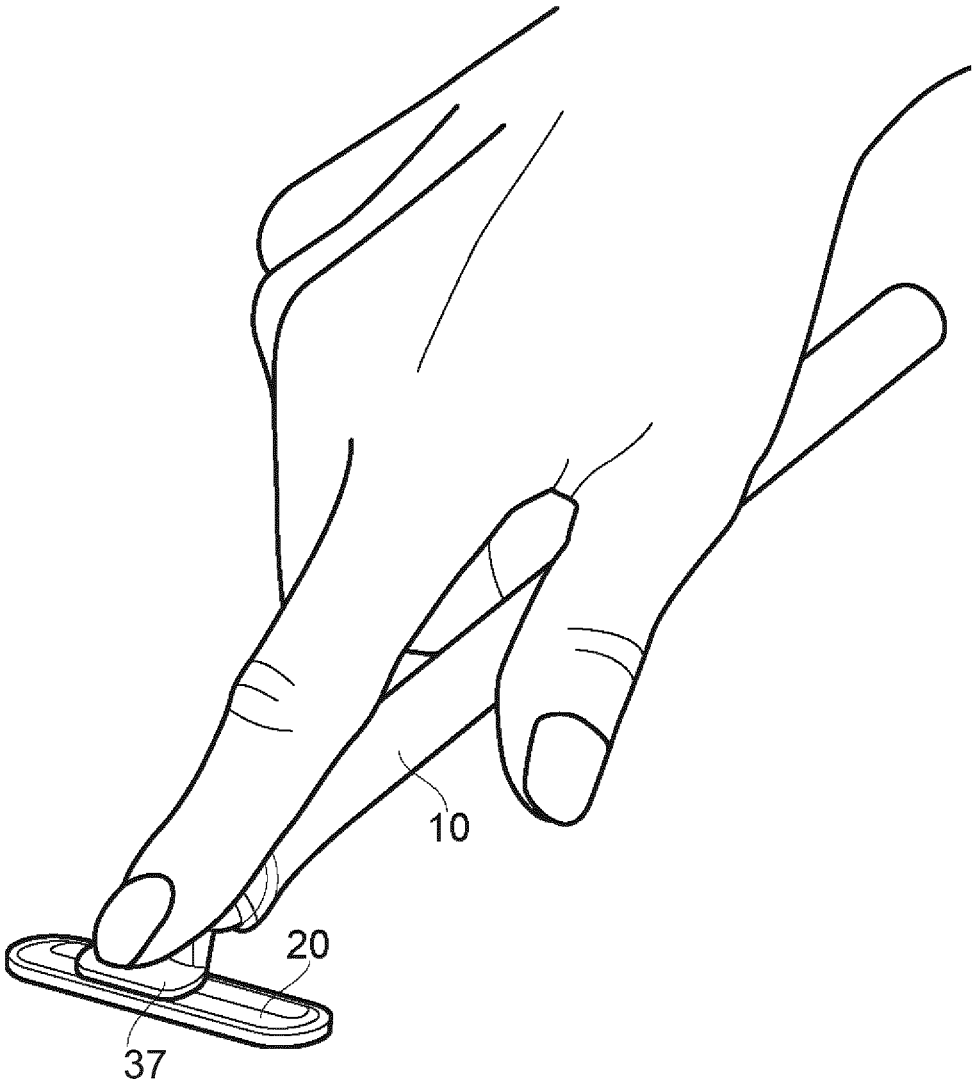
Figure 4:
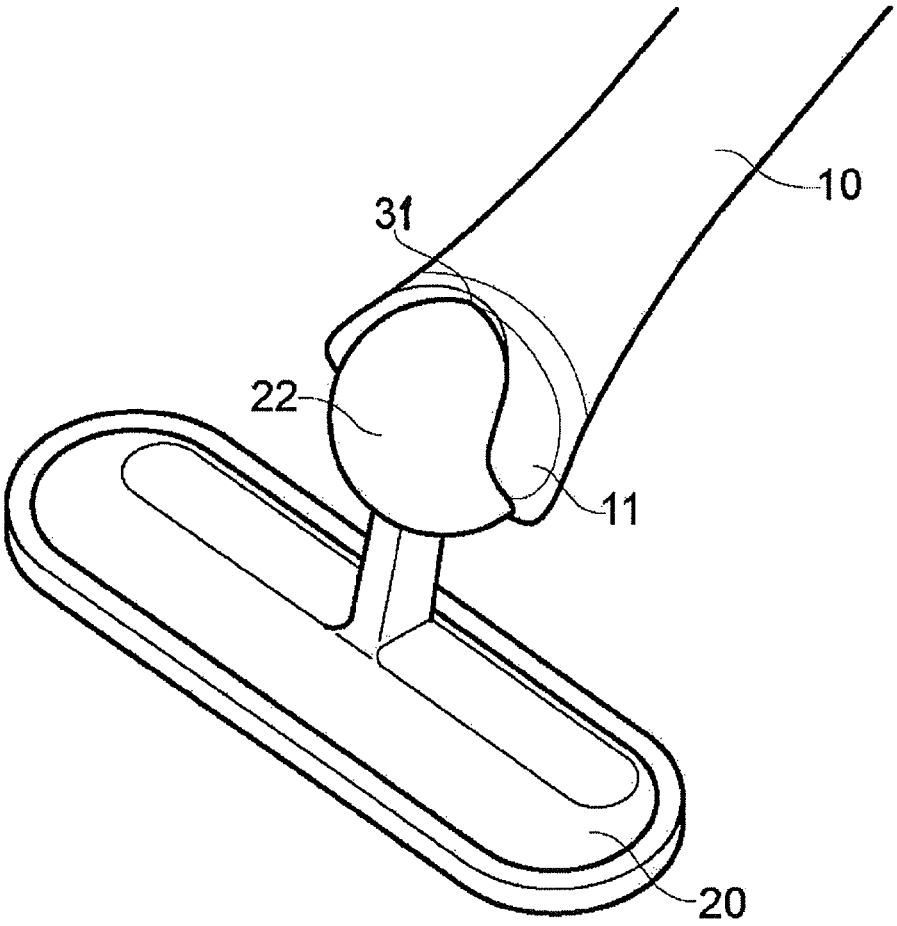
FIG. 4 shows a further embodiment of a braking element.

FIGS. 3 and 4 illustrate embodiments of a braking element 37. To the extent to which the features of FIGS. 3 and 4 coincide with those of the embodiments previously described, reference is made to the features described above.

FIG. 3*a* illustrates an embodiment of a braking element 37, which is designed as a resting surface for a finger of the user. To the extent to which the features of FIG. 3*a* coincide with those of the embodiments previously described, reference is made to the features described above. The braking element 37 is provided as an extension of the connecting web 35 on the surface of the blade head 20. As shown in FIG. 3*b*, during use of the razor 1 as intended the user places his/her finger on the braking element 37, while he/she securely holds the razor 1 by the handle 10. As a result, the user's hand establishes a connection between the handle 10 and the blade head 20 that fixes the deflection of the blade head 20, which leads to a "braking" or fixing of the deflection of the blade head 20.

FIG. 4 illustrates an embodiment of a braking element that is designed as a recess 31 in the joint socket 11. During use of the razor 1 as intended, the user places his/her finger on the joint head 22, the surface of which is partially accessible in the recess 31, while he/she securely holds the razor 1 by the handle 10. As a result, the user's hand establishes a connection between the handle 10 and the blade head 20 that fixes the deflection of the blade head 20, which leads to a "braking" or fixing of the deflection of the blade head 20.

Figure 5A:
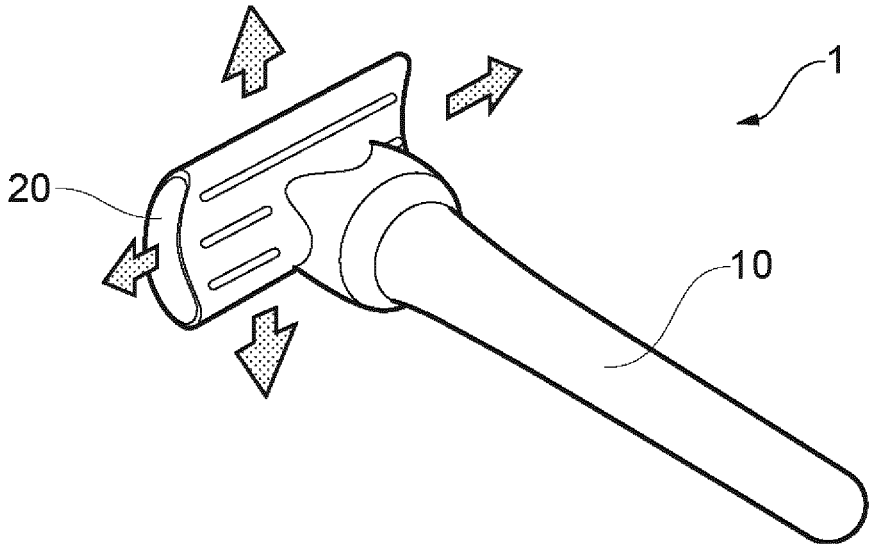
FIGS. 5*a* and 5*b* show a further embodiment of a razor according to the invention and FIG. 6 illustrates the rotational movability.
Figure 5B:
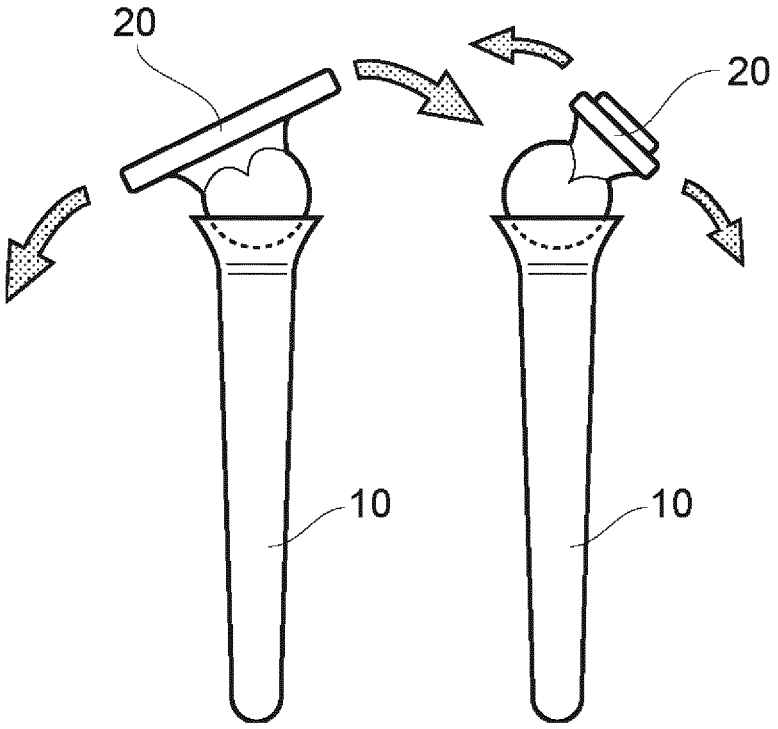

FIG. 5 illustrates a further embodiment of a razor 1. The embodiment of FIG. 5 differs substantially from the previously described embodiments in the design of the blade head 20. The blade head 20 of FIG. 5 does not have a connecting web 35, but is arranged directly on the ball joint head 22.

Figure 6:
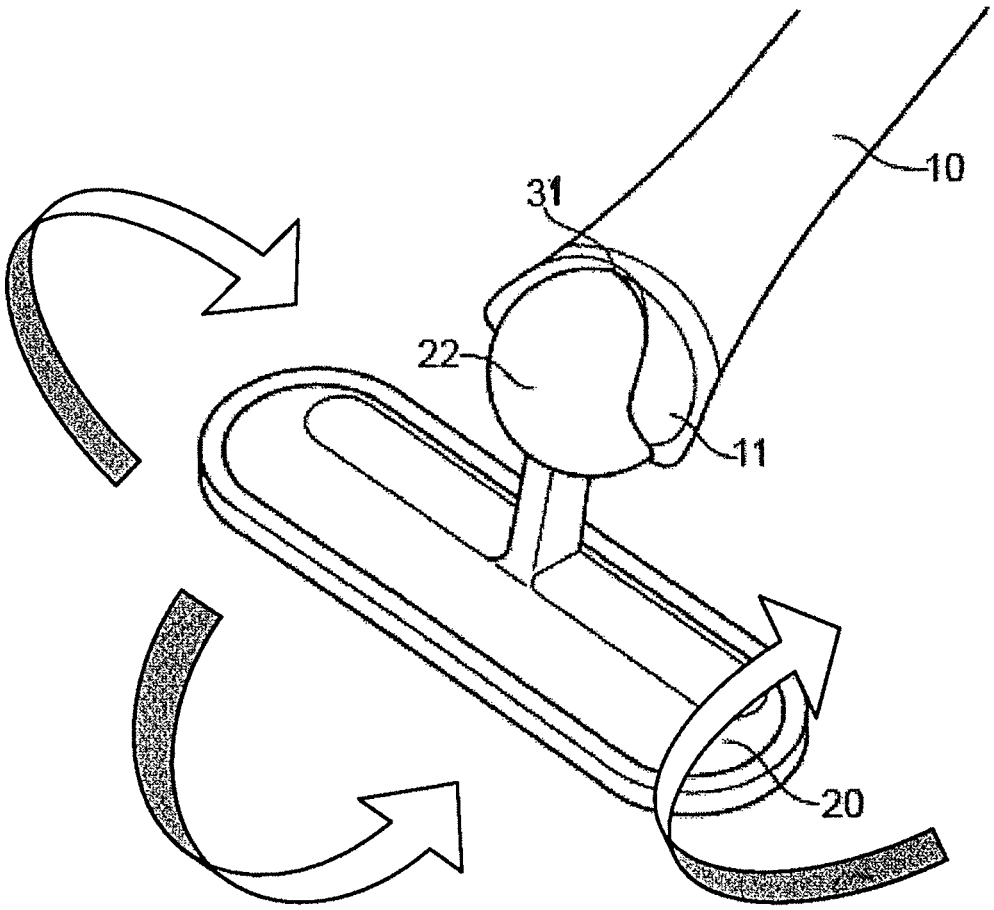

As illustrated in FIGS. 5 and 6 by the arrows, the razor 1 has a blade head 20 which is movable by 360° and has a ball joint head 22 and a handle 10 with a joint socket 11. The blade head 20 is movable rotatably in all three directions with respect to the handle. The movability of the ball joint 11, 22 makes possible optimal adaptation to areas of the body that are difficult to access (knee, ankle), and thus prevents injuries in the form of cuts. The ball joint 11, 22 is at the same time the changing element for the blade head 20 and consists of a flexible material (for example TPE (thermoplastic elastomer)). Different materials and degrees of elasticity of the ball joint 11, 22 allow different pressure points to be introduced into the razor 1. It is additionally possible for the user to vary and/or fix the degree/angle of the flexibility by placing the index finger on the ball joint 11, 22.

The various levels of flexibility in the ball joint 11, 22 are obtained by the choice of material (different thermoplastic elastomers) and by the action of the user. The handle 10 with a joint socket 11 consists of a strong, impact-resistant material (for example ABS (acrylonitrile butadiene styrene)) and may also be covered with grip elements such as roughened zones, grooving and nonslip materials.

For skincare, the blade head 20 may include a care strip (balsam strip) with emulsions and nourishing oils.

As a result of its increased movability, the razor 1 with a ball joint 11, 22 that is movable by 360° improves the adaptation of the blade head 20 to regions of the body that are difficult to access. The individual adaptation of the razor 1 to different, sensitive portions of the skin can be ensured by multiple levels of flexibility (different materials) and different blade heads 20. The user can also determine himself/herself the degree of movability by applying the index finger.

The degrees of flexibility of the suspension of the ball joint, the materials of the handle and/or of the blade head are further influencing factors that make an individual shave possible. In a way similar to the suspensions of toothbrush heads, it is also possible according to the invention for the blade head or the ball joint to achieve an exertion of soft, medium or hard pressure by means of suspensions that can bend to differing extents. The user can then select appropriate razors according to his/her needs.

LIST OF REFERENCE NUMERALS

1 Razor
10 Handle
11 Ball joint socket
14 Alignment element
20 Blade head
21 Razor blades
22 Ball joint head
35 Connecting web
36 Recess
37 Braking element

What is claimed is:

1. A razor, wherein the razor comprises a handle having a ball joint socket at one end thereof, and a blade head comprising at least one razor blade and a ball joint head, the ball joint head of the blade head and the ball joint socket of the handle forming a ball joint, and wherein the handle comprises in the ball joint socket an elastic alignment element, which is designed to engage in a recess in the ball joint head and to return the ball joint head into a starting position with respect to the handle once the blade head is no longer exposed to loading.

2. The razor of claim 1, wherein the elastic alignment element is in the form of a pin.

3. The razor of claim 2, wherein the pin engages in the recess in the ball joint head in a form-fitting manner.

4. The razor of claim 1, wherein the ball joint head of the blade head is arranged detachably in the ball joint socket of the handle.

5. The razor of claim 1, wherein the blade head is movable rotatably in all three directions with respect to the handle.

6. The razor of claim 1, wherein the blade head is movable by 360°.

7. The razor of claim 1, wherein the razor further comprises a braking element for braking a rotational movement of the ball joint head in the ball joint socket.

8. The razor of claim 7, wherein the braking element is designed as a resting surface for a finger of a user.

9. The razor of claim 7, wherein the braking element is designed as a recess in the joint socket.

10. The razor of claim 1, wherein the ball joint head is formed at least partially from an elastic material.

11. The razor of claim 10, wherein the elastic material comprises a thermoplastic elastomer.

12. The razor of claim 1, wherein different parts of the ball joint head have different elasticities.

13. The razor of claim 12, wherein subregions of the ball joint head which are closer to the blade head are more elastic than subregions which lie closer to the handle.

14. The razor of claim 12, wherein subregions of the ball joint head which are closer to the blade head are less elastic than subregions which lie closer to the handle.

15. The razor of claim 1, wherein the blade head is connected to the ball joint head by a connecting web.

16. The razor of claim 1, wherein the blade head is connected directly to the ball joint head.

17. The razor of claim 1, wherein the blade head comprises a special blade.

18. The razor of claim 1, wherein the blade head comprises a balsam strip.

19. The razor of claim 1, wherein the handle comprises grip elements for nonslip holding of the handle by a user.

20. A method for producing the razor of claim 1, wherein the method comprises:

providing a handle having a ball joint socket comprising an elastic alignment element therein at one end thereof, and providing a blade head comprising at least one razor blade and a ball joint head comprising a recess therein, the ball joint head of the blade head and the ball joint socket of the handle being designed to form a ball joint, and the alignment element being designed to engage in the recess in the ball joint head and to return the ball joint head into a starting position with respect to the handle once the blade head is no longer exposed to loading.

* * * * *